US011105494B2

(12) United States Patent
Ma et al.

(10) Patent No.: US 11,105,494 B2
(45) Date of Patent: Aug. 31, 2021

(54) LOCKING DEVICE FOR A TACTICAL LIGHT FOR KEY-MOD AND M-LOK RAILS

(71) Applicant: Shenzhen Olight E-Commerce Technology Co., Ltd., Guangdong (CN)

(72) Inventors: Qiang Ma, Shanxi (CN); Ziyang Zhou, Hubei (CN)

( * ) Notice: Subject to any disclaimer, the term of this patent is extended or adjusted under 35 U.S.C. 154(b) by 0 days.

(21) Appl. No.: 17/129,925

(22) Filed: Dec. 22, 2020

(65) Prior Publication Data

US 2021/0131651 A1 May 6, 2021

(30) Foreign Application Priority Data

Jun. 16, 2020 (CN) ..... 202010547026.3

(51) Int. Cl.
*F21V 21/00* (2006.01)
*F21V 21/14* (2006.01)
*F21V 21/34* (2006.01)

(52) U.S. Cl.
CPC ..... *F21V 21/14* (2013.01); *F21V 21/34* (2013.01); *F21V 21/145* (2013.01)

(58) Field of Classification Search
CPC ..... F21V 21/34; F21V 21/14; F21V 21/145; F21K 9/20; F41G 1/34; F41G 1/345; F41G 1/35; F41G 1/38
See application file for complete search history.

(56) References Cited

U.S. PATENT DOCUMENTS 10,184,756 B1 * 1/2019 McCauley ..... F21V 21/34 362/110
2005/0243542 A1 * 11/2005 Kim ..... F41G 1/34 362/110
2015/0267993 A1 * 9/2015 Cheng ..... F41G 11/001 362/110
2017/0343319 A1 * 11/2017 Galli ..... F41G 1/35 362/110

* cited by examiner

*Primary Examiner* — Y M. Quach Lee
(74) *Attorney, Agent, or Firm* — Prakash Nama; Global IP Services, PLLC

(57) ABSTRACT

This invention includes a first base which is movably connected to the rail; an end surface of the first base which is close to the rail is further provided with a first hooking part for hooking the rail; a movable pull rod which is movably connected to the first base and includes a first connecting part, a second hooking part for hooking the rail, and a first adjusting part connected to the first connecting part; the first connecting part is fixed to an inner wall of the chamber through a first elastic member, so that the first hooking part and the second hooking part form a clamping device; a rack fixedly mounted inside the chamber; the rack teeth and the teeth cooperate to fix the movable pull rod and the rack; a second base for fixing the tactical light.

10 Claims, 9 Drawing Sheets

LOCKING DEVICE FOR A TACTICAL LIGHT FOR KEY-MOD AND M-LOK RAILS

BACKGROUND OF THE INVENTION

The present invention relates to the technical field of tactical lights, and more specifically relates to a locking device for a tactical light for Key-hole Modular and Modular Lock (M-lok) rails.

In Key-mod rails and M-lok rails, which are currently popular firearm accessories, it is common for the tactical lights to be locked to the Key-mod rails or M-lok rails by screw connection. When mounting or detaching the tactical lights, tools are required to loosen the screws before the tactical lights could be detached. Besides, when these two different rails are used separately, it is usually necessary to use different accessories to fix the tactical lights to the rails, so that the accessories used for fixing cannot be used in common. On the other hand, the tactical lights currently in use are directly fixed by screws. When the user wants to change the tactical light models, detachment and replacement are not convenient for different types of tactical lights.

BRIEF SUMMARY OF THE INVENTION

In view of the aforesaid disadvantages now present in the prior art, the present invention provides a locking device for a tactical light for Key-mod and M-lok rails wherein one locking device is applicable for both Key-mod and M-lok rails, resulting in better compatibility for the tactical lights and also ensuring better convenience in detaching or mounting of the tactical lights to the rails.

The present invention provides the following technical solutions:

A locking device for a tactical light for Key-mod and M-lok rails comprising:

a first base which is movably connected to the rail and provided with a chamber; an opening is formed on each of two opposite side walls of the chamber; an end surface of the first base which is close to the rail is further provided with a first hooking part for hooking the rail;

a movable pull rod which is movably connected to the first base and comprises a first connecting part, a second hooking part connected to the first connecting part for hooking the rail, and a first adjusting part connected to the first connecting part; the second hooking part passes through the opening on one of the side walls of the chamber to be disposed outside the chamber; the first adjusting part passes through the opening on the other side wall of the chamber to be disposed outside the chamber; the first connecting part is fixed to an inner wall of the chamber through a first elastic member, so that the first hooking part and the second hooking part form a clamping device for fixing the first base and the rail; the first connecting part is further provided with teeth;

a rack fixedly mounted inside the chamber and provided with rack teeth; the rack teeth and the teeth cooperate to fix the movable pull rod and the rack;

a second base for fixing the tactical light and having a first end surface which is fixed to the tactical light and a second end surface which is fixed to the first base; the first end surface and the second end surface of the second base face each other.

Furthermore, the locking device for tactical light further comprises a lever rotatably connected to the first base; the lever comprises a second connecting part, a third hooking part extending from a first end of the second connecting part, a third connecting part disposed between the second connecting part and the third hooking part, and a second adjusting part extending from a second end of the second connecting part; the third connecting part is connected to the inner wall of the chamber through a shaft pin, so that the lever is rotatably connected to the first base; a slot which extends along a stretching direction of a second elastic member is formed on a side wall of the first base; the second connecting part is fixed to the inner wall of the chamber through the second elastic member; the third hooking part is fixed with the second base; the second adjusting part passes through the slot to be disposed outside the chamber; the first end and the second end of the second connecting part face each other.

Furthermore, the second end face of the second base is provided with two sliding platforms; the first base is correspondingly provided with a sliding slot; the sliding platforms are inserted in the sliding slot; the sliding platforms cooperate with the sliding slot so that the second base can move relative to the first base; the third hooking part hooks a side wall of one of the sliding platforms so that the second base can be fixed with the first base.

Furthermore, the openings are elongated in shape, and the openings each has a longitudinal direction which is parallel to a longitudinal direction of the first elastic member.

Furthermore, the first elastic member and the second elastic member are springs.

Furthermore, an end surface of the first connecting part which is distant from the rack teeth is an inclined surface.

Furthermore, hook legs are provided on the first hooking part and the second hooking part, and the hook leg of the first hooking part and the hook leg of the second hooking part are arranged in opposite direction.

Furthermore, a side block is fixed in the chamber; a recess is provided on an end surface of the side block which is close to the first connecting part; the recess has a shape which corresponds to that of the side block.

Furthermore, a guide pin is provided in the chamber; the first elastic member has a first end which is fixed to the guide pin and a second end which is fixed to the first connecting part.

A rail, wherein the rail is provided with a first elongated slot on an end surface which is close to the first hooking part.

The present invention has the following beneficial advantages:

With the configuration of the structures and positions of the first base and the movable pull rod, the movable pull rod forms a lever device; and by fixing the first connecting part to the inner wall of the chamber through the first elastic member, the movable pull rod can move in the chamber. Furthermore, by providing a first hooking part at the first base, and providing a second hooking part at the movable pull rod, the first hooking part and the second hooking part form a clamping device, thereby ensuring that the first base can be fixed to the rail. As a result, one locking device can be applied to both Key-mod rail and M-lok rail; this not only ensures the versatility of the tactical light, but also ensures that the tactical light cam be mounted to or detached from the rail in a more rapid and convenient manner. By engaging the teeth and the rack teeth on the rack, and by rotating the first adjusting part so that the rack teeth can be engaged with the movable pull rod, the movable pull rod is prevented from driving the spring to move backwards due to excessive recoiling force during shooting. By providing the second base, and providing a sliding platform on the second base and a sliding slot on the first base, the first base and the second base can move relative to each other by cooperation of the sliding platform and the sliding slot; the lever is configured by having the second connecting part fixed to the inner wall of the chamber through the second elastic member, and the third connecting part rotatably connected to the inner wall of the chamber through the shaft pin, the lever forms a lever device which ensures that when the second adjusting part is pressed, the third hooking part is engaged with or disengaged from the side wall of the sliding platform; as a result, it is convenient for the second base to be mounted to or detached from the first base. By configuring the end face of the first connecting part which is distant from the rack teeth as an inclined surface, the inner wall of the chamber is prevented from abutting against the first connecting part when pushing the first adjusting part, thereby facilitating the first connecting part to move inside the chamber. By providing the guide pin, deformation of the spring in the vertical direction can be reduced when the movable pull rod compresses the spring, so that the movable pull rod can maintain horizontal movement when the spring is compressed.

Figure 1:
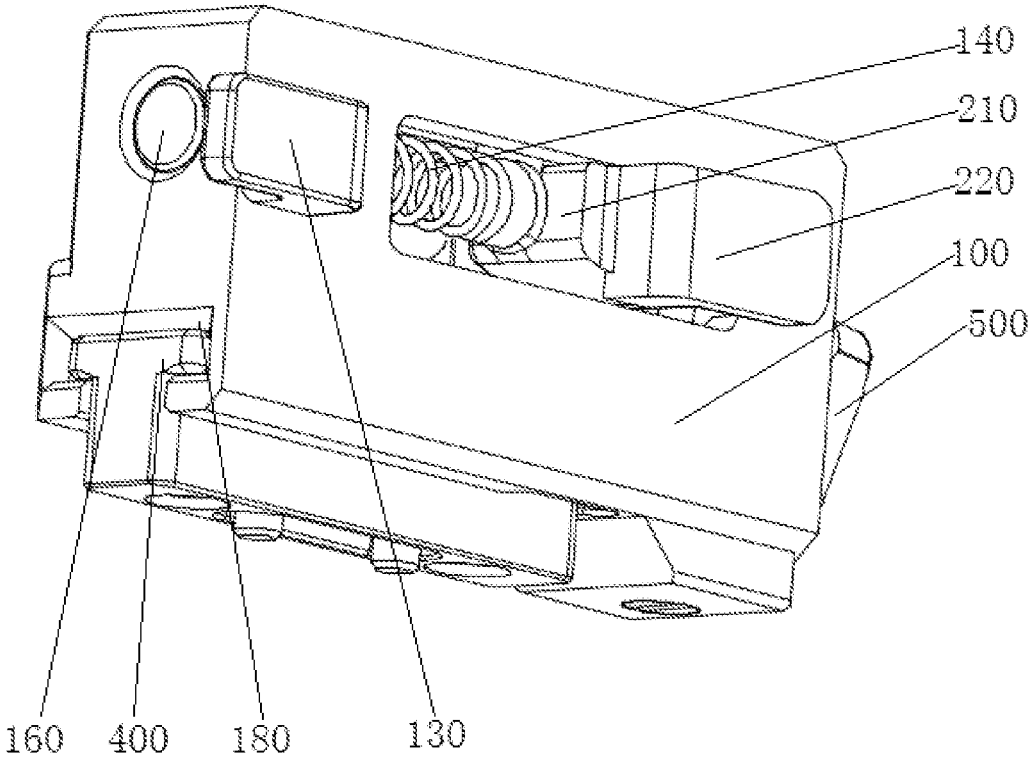
FIG. 1 is a schematic structural view of the present invention.

References in the figures: 100—first base; 110—chamber; 120—opening; 130—first hooking part; 140—first elastic member; 150—second elastic member; 160—guide pin; 170—slot; 180—sliding slot; 200—movable pull rod; 210—first connecting part; 220—second hooking part; 221—hook leg; 230—first adjusting part; 231—strip-shaped protrusion; 240—teeth; 300—rack; 310—rack teeth; 400—second base; 410—sliding platform; 500—lever; 510—second connecting part; 520—third hooking part; 530—third connecting part; 540—second adjusting part; 550—shaft pin; 600—side block; 610—recess; 700—first elongated slot; 800—rail; 810—through hole; 900—tactical light.

DETAILED DESCRIPTION OF THE INVENTION

An embodiment of the present invention is further described in detail below. The embodiment is illustrated in the figures. Identical or like references throughout the description and the figures represent identical or like components or components having the same or similar functions. The embodiment described below with reference to the figures should be considered illustrative for the purpose of explaining the technical features of the present invention, and should not be considered as any limitation to the present invention.

In the present invention, it should be noted that directions or positional relationships indicated by terms such as "length", "width", "upper", "lower", "front", "rear", "left", "right", "vertical", "horizontal", "top", "bottom", "inner", "outer" should be understood based on the directions or positional relationships according to the figures, and should also be understood as merely means for simplification for the sake of easier illustration of the present invention. It is not meant or intended to mean that the devices or components concerned should have such specifically described directions, or should be configured or operated according to the specifically described directions, and hence should not be considered as any limitation to the present invention.

Further, terms like "first", "second" are used for illustrative purpose, and should not be understood as meaning or implying relative importance or as a subtle indication of a quantity of the described technical feature. Therefore, a feature defined by "first" or "second" may comprises by obvious indication or subtle implication, one or more than one of said feature in terms of quantity. In the description, "a plurality of" means a quantity of two or above, unless otherwise specified.

In the present invention, unless otherwise specified, terms such as "install", "connect", "communicate" and "fix" should be understood broadly. For example, a fixed connection, a removable connection, or integral formation may be intended. Further, connection may be mechanical or electrical, direct or indirect through a medium, and may be an internal communication between two components or an interactive relationship between two components. A person skilled in this field of art should be able to understand the specific meaning of the terms described in the present invention according to the context of the practical situation described.

With reference to FIGS. 1 to 4, a locking device for a tactical light 900 for Key-mod and M-lok rails 800 comprises a first base 100 movably connected to the rail 800, a movable pull rod 200 movably connected to the first base 100, a rack 300 fixedly mounted in a chamber 110, and a second base 400 for fixing the tactical light 900.

Figure 5:
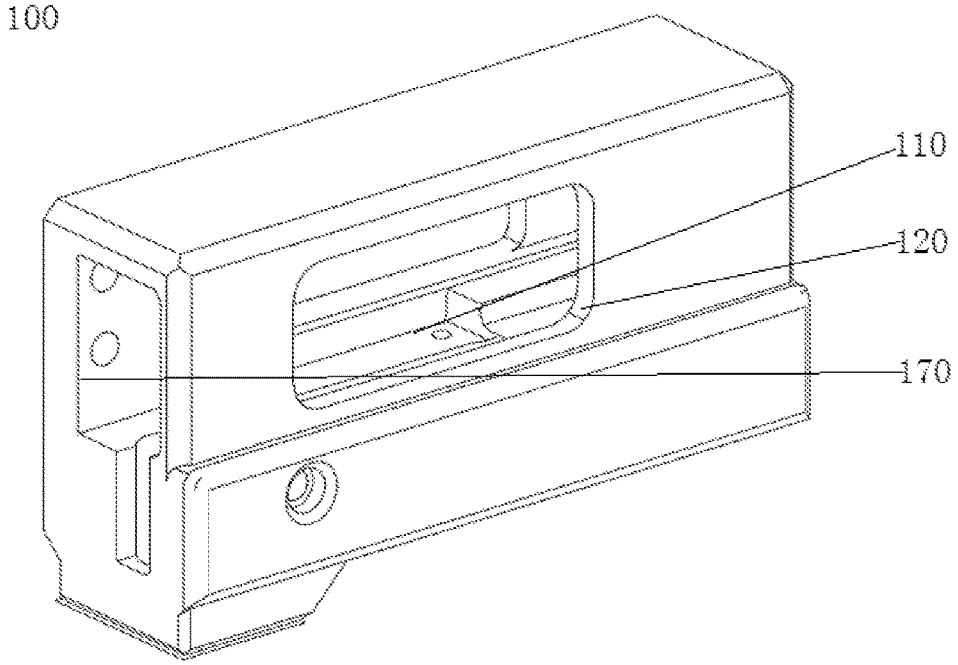
FIG. 5 is a schematic structural view of the first base of the present invention.

With reference to FIG. 5, the first base 100 is provided with the chamber 110. An opening 120 is formed on each of two opposite side walls of the chamber 110. An end surface of the first base 100 which is close to the rail 800 is further provided with a first hooking part 130 for hooking the rail 800. In this embodiment, each of the openings 120 is elongated in shape; each of the openings 120 has a longitudinal direction which is parallel to a longitudinal direction of a first elastic member (140); each of the openings 120 has a width which is greater than a height of a connecting rod which is used to connect a first adjusting part 230 and a first connecting part 210, so that when the first adjusting part 230 is pressed, the movable pull rod 200 can rotate.

Figure 7:
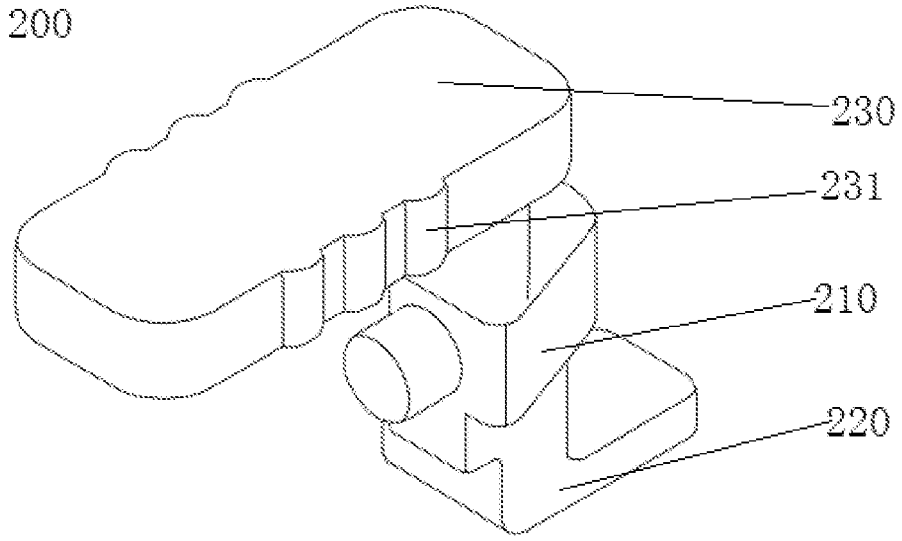
FIG. 7 is a schematic structural view of the movable pull rod of the present invention.
Figure 8:
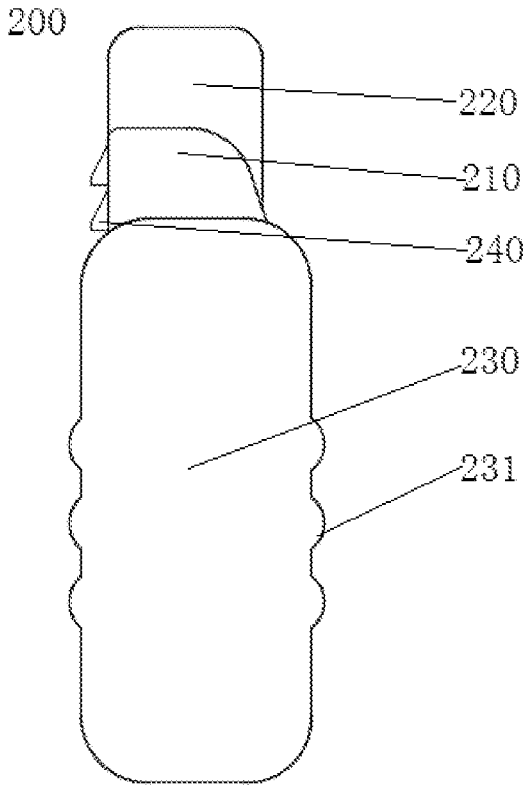
FIG. 8 is a top view of the movable pull rod of the present invention.
Figure 10:
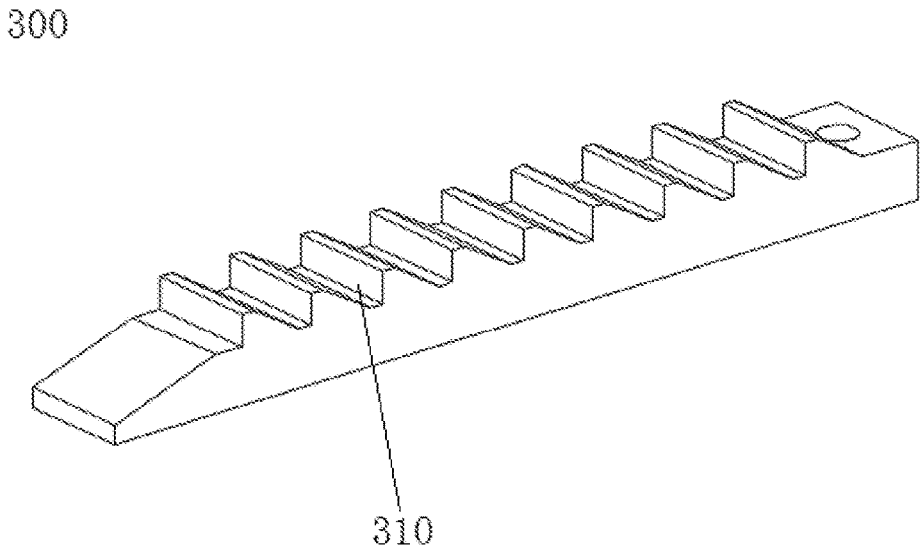
FIG. 10 is a schematic structural view of the rack of the present invention.

With reference to FIGS. 7, 8 and 10, the movable pull rod 200 comprises the first connecting part 210, a second hooking part 220 connected to the first connecting part 210 for hooking the rail 800, and the first adjusting part 230 connected to the first connecting part 210. The second hooking part 220 passes through the opening 120 on one of the side walls of the chamber 110 to be disposed outside the chamber 110. The first adjusting part 230 passes through the opening 120 on the other side wall of the chamber 110 to be disposed outside the chamber 110. The first connecting part 210 is fixed to an inner wall of the chamber 110 through a first elastic member 140, so that the first hooking part 130 and the second hooking part 220 form a clamping device for fixing first base 100 and the rail 800. The first connecting part 210 is further provided with teeth 240. A rack 300 is provided with rack teeth 310. The teeth 240 and the rack teeth 310 cooperate to fix the movable pull rod 200 and the rack 300. An end surface of the first connecting part 210 distant from the rack teeth 310 is an inclined surface. A guide pin 160 is provided in the chamber 110. The first elastic member 140 has a first end which is fixed to the guide pin 160 and a second end which is fixed to the first connecting part 210. The first adjusting part 230 has a side wall which is evenly provided with strip-shaped protrusions 231. The strip-shaped protrusion 231 can increase the friction force generated by the contact between the hand and the first connecting part 210, thereby achieving an anti-slip effect. In this embodiment, the first elastic member 140 is a spring.

Figure 6:
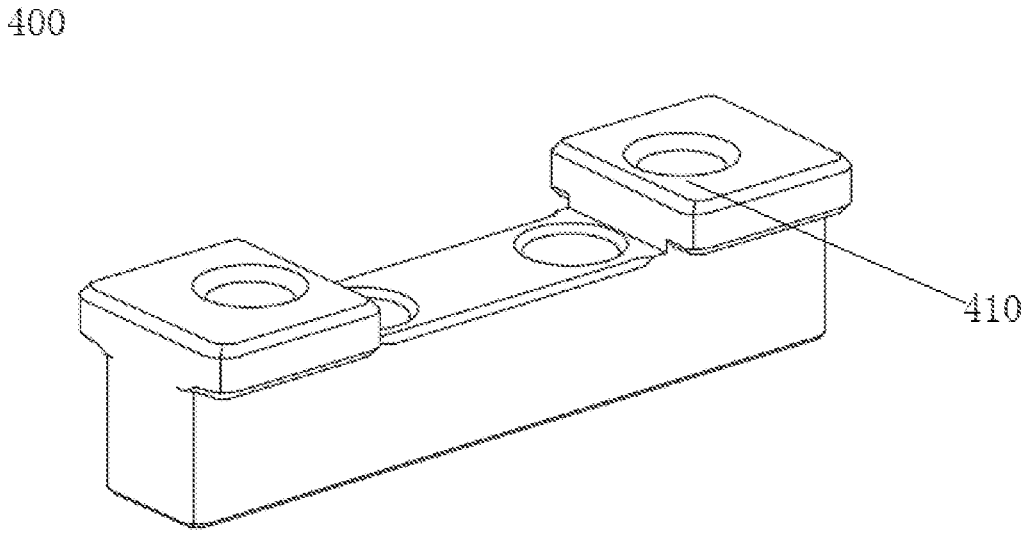
FIG. 6 is a schematic structural view of the second base of the present invention.

With reference to FIG. 6, the second base 400 has a first end surface which is fixed to the tactical light 900 and a second end surface which is fixed to the first base 100. The first end surface and the second end surface of the second base 400 face each other. In this embodiment, a fixing block is provided on an end surface of the tactical light 900 which is close to the second base 400. The fixing block is provided with a threaded hole, and the tactical light 900 is fixed to the second base 400 by screw connection.

Figure 4:
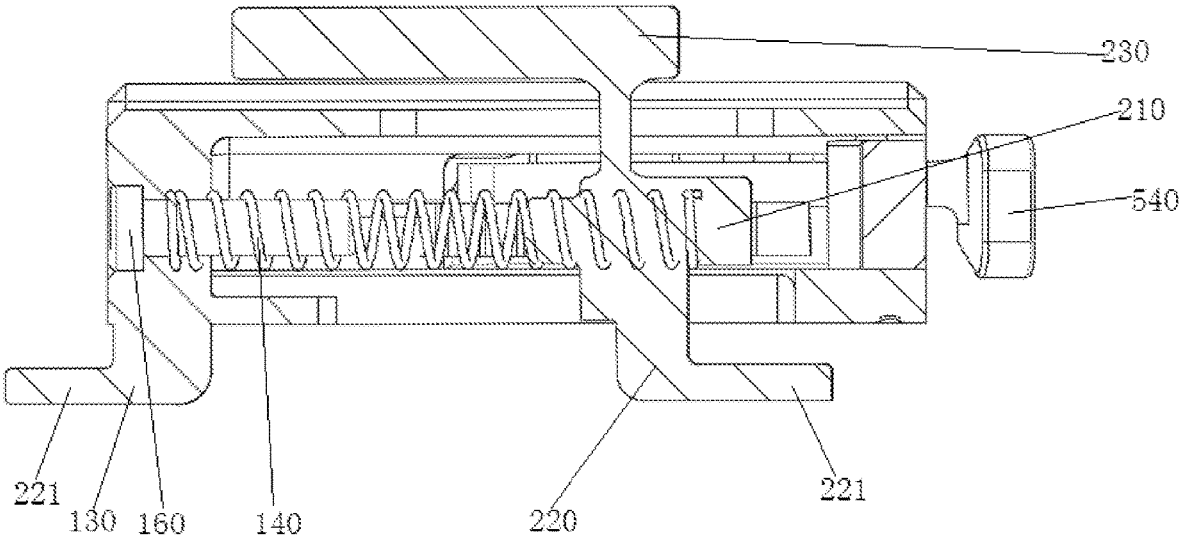
FIG. 4 is an A-A sectional view of the present invention.

With reference to FIG. 4, in this embodiment, hook legs 221 are provided on the first hooking part 130 and the second hooking part 220, and the hook leg 221 of the first hooking part 130 and the hook leg 221 of the second hooking part 220 are arranged in opposite direction. When the first base 100 is fixed to the rail 800, inner side walls of the hook legs 221 are respectively in contact with a side wall of the first elongated slot 700. At this time, the spring has not been deformed or compressed. In this embodiment, the first hooking part 130 and the second hooking part 220 are both bent away from the opening 120. In other embodiments, the first hooking part 130 and the second hooking part 220 are both bent towards the opening 120. At this time, the spring is initially in a stretched state.

Figure 12:
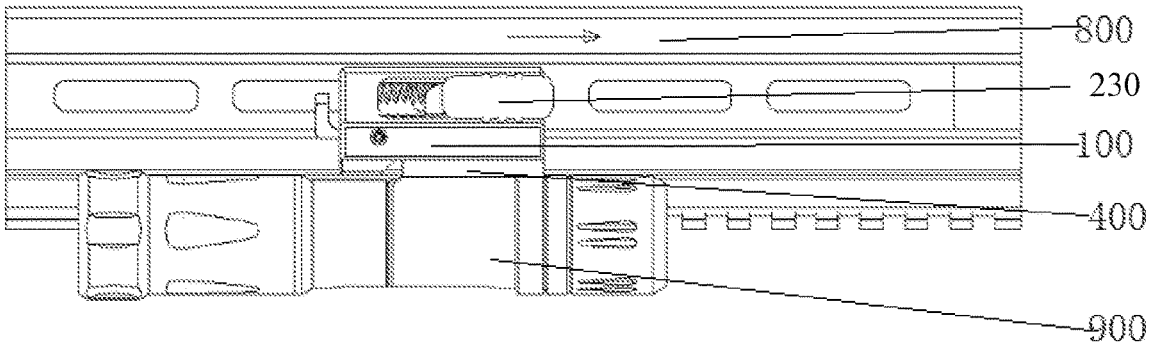
FIG. 12 is a schematic view showing a state when the movable pull rod is pushed.
Figure 13:
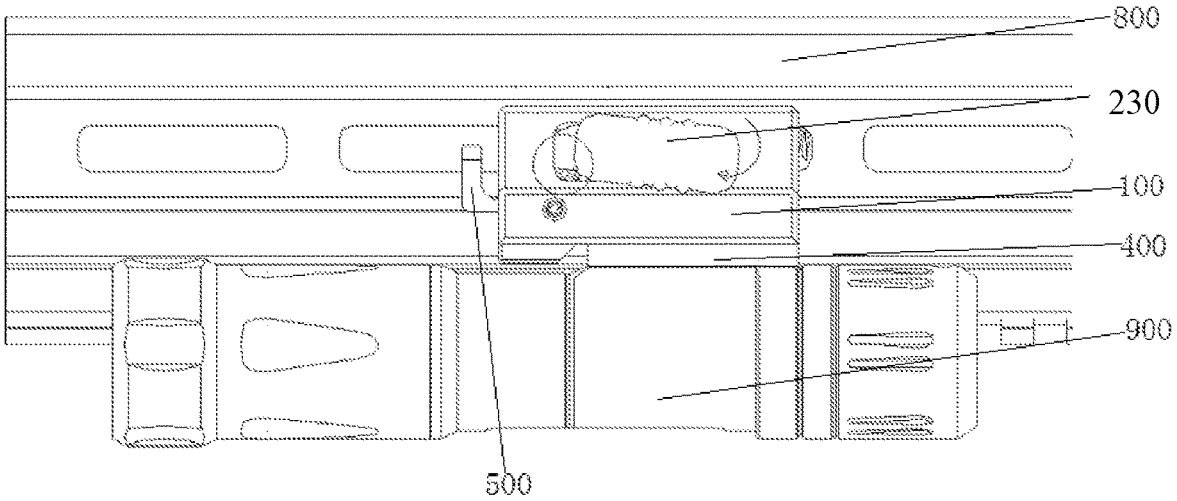
FIG. 13 is a schematic view showing a state when the teeth and the rack teeth are not engaged with each other.

With reference to FIGS. 12 and 13, the spring is in a non-deformed or compressed state. During mounting, a clockwise force is applied to the first adjusting part 230. While the force is applied, the spring is deformed in a vertical direction, so that the first adjusting part 230 can rotate clockwise. The first adjusting part 230 drives the first connecting part 210 to rotate clockwise so that the teeth 240 are disengaged from the rack teeth 310. At this time, the movable pull rod 200 can move in the chamber 110. Then, pull the first adjusting part 230, thereby compressing the spring, and the movable pull rod 200 then moves towards the guide pin 160; the first hooking part 130 is hooked with the side wall of the first elongated slot 700 of the rail 800. The second hooking part 220 is inserted in the first elongated slot 700; then release the first adjusting part 230. When the spring is not fully restored to the initial state, the second hooking part 220 abuts against the side wall of the first elongated slot 700, thereby enabling the first hooking part 130 and the second hooking part 220 to clamp the rail 800 so as to fix the first base 100 to the firearm rail. When stop applying the force to the first adjusting part 230, the spring restores to its initial form in the vertical direction; the teeth 240 are then engaged with the rack teeth 310 on the rack 300 to fix the movable pull rod 200 to the rack 300. During detachment, a clockwise force is applied to the first adjusting part 230, and the teeth 240 are disengaged from the rack teeth 310; then pull the first adjusting part 230 and slide the first base 100 so that the side wall of the rail 800 no longer abuts against the first hooking part 130 and the second hooking part 220, then the first hooking part 130 and the second hooking part 220 are removed from the firearm rail to achieve detachment of the first base 100 from the rail 800.

The spring is in a stretched state. During mounting, the first hooking part 130 is hooked with the side wall of the first elongated slot 700 of the rail 800; then a clockwise force is applied to the first adjustment part 230. At the same time when the force is applied, the spring deforms in the vertical direction, so that the first adjusting part 230 can rotate clockwise; the first adjusting part 230 drives the first connecting part 210 to rotate clockwise so that the teeth 240 are disengaged from the rack teeth 310. When the spring is not fully restored to the initial state, the inner side of the hook leg of the second hooking part 220 abuts against the side wall of the first elongated slot 700, thereby enabling the first hooking part 130 and the second hooking part 220 to clamp the rail 800 so as to fix the first base 100 to the firearm rail. When stop applying the force to the first adjusting part 230, the spring restores its initial form in the vertical direction; the teeth 240 are then engaged with the rack teeth 310 on the rack 300 to fix the movable pull rod 200 to the rack 300. During detachment, in contrast with the detachment method when the spring is in a non-deformed or compressed state, after the teeth 240 are disengaged from the rack teeth 310, pull the movable pull rod 200 so that the spring in a stretched state until the side wall of the rail 800 no longer abuts against the first hooking part 130 and the second hooking part 220, then the first hooking part 130 and the second hooking part 220 are removed from the firearm rail to achieve detachment of the first base 100 from the rail 800.

Figure 9:
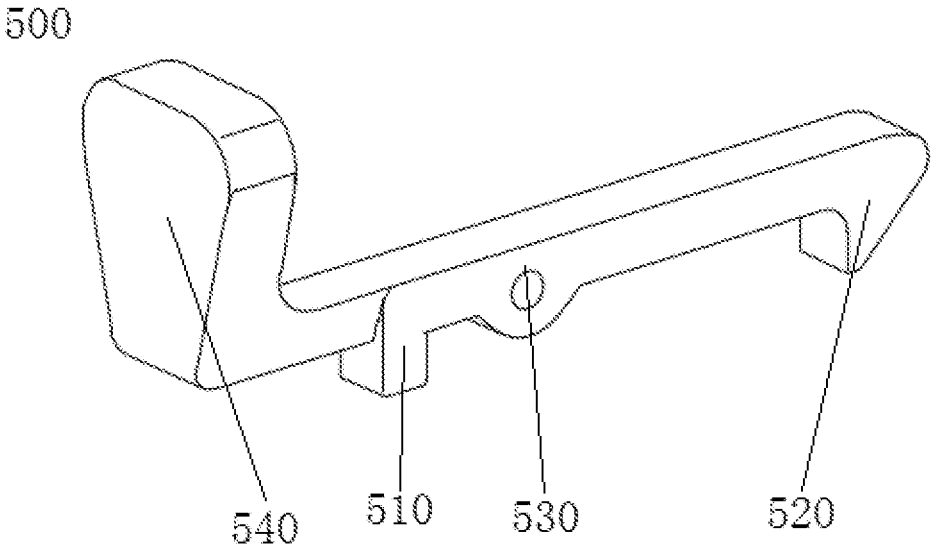
FIG. 9 is a schematic structural view of the lever of the present invention.
Figure 11:
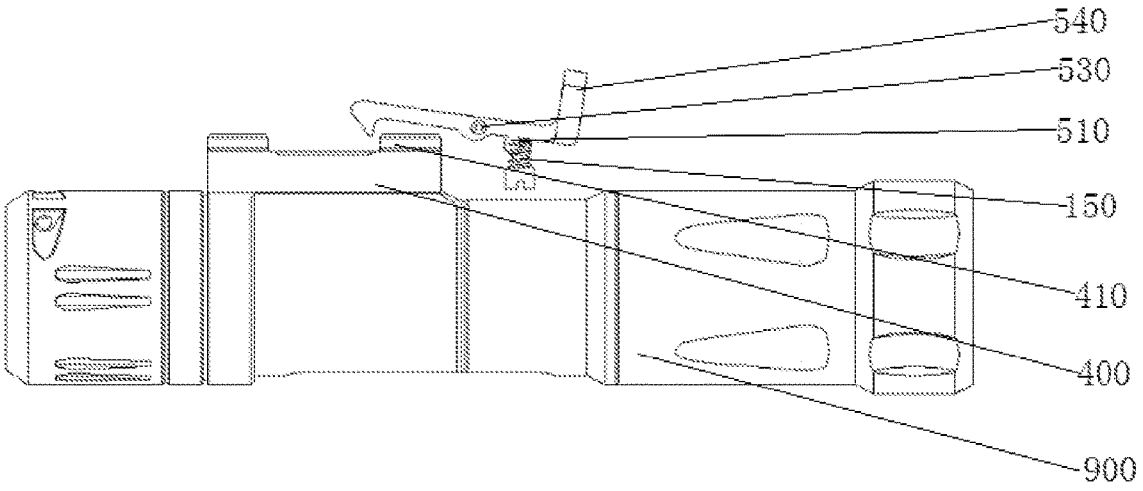
FIG. 11 is a schematic view showing a state when the lever is not yet engaged with the sliding platform.

With reference to FIGS. 9 and 11, in this embodiment, the locking device for the tactical light 900 further comprises a lever 500 rotatably connected to the first base 100. The lever 500 comprises a second connecting part 510, a third hooking part 520 extending from a first end of the second connecting part 510, a third connecting part 530 disposed between the second connecting part 510 and the third hooking part 520, and a second adjusting part 540 extending from a second end of the second connecting part 510. The third connecting part 530 is connected to the inner wall of the chamber 110 through a shaft pin 550, so that the lever 500 is rotatably connected to the first base 100. A slot 170 is formed on a side wall of the first base 100 which extends along a stretching direction of a second elastic member 150; the second connecting part 510 is fixed to the inner wall of the chamber 110 through the second elastic member 150. Specifically, the second connecting part 510 is fixed to a bottom wall of the chamber 110 through the second elastic member 150. The third hooking part 520 is fixed to the second base 400. The second adjusting part 540 passes through the slot 170 to be disposed outside the chamber 110. The slot 170 is further provided with a second elongated slot along a vertical moving direction of the second adjusting part 540, so that the second adjusting part 540 can move with the compression of the second elastic member 150. The first end and the second end of the second connecting part 510 face each other. In this embodiment, the second elastic member 150 is a spring. In other embodiments, a tension spring can also be used instead of the spring. At this time, the second connecting part 510 is connected to a top wall of the chamber 110 through the second elastic member 150. When the third hooking part 520 abuts against the sliding platform 410, the tension spring is in a stretched state.

With reference to FIG. 6, in this embodiment, the second end surface of the second base 400 is provided with two sliding platforms 410, and the first base 100 is correspondingly provided with a sliding slot 180. The sliding platforms 410 are inserted in the sliding slot 180. The sliding platforms 410 cooperate with the sliding slot 180 so that the second base 400 can move relative to the first base 100. The third hooking part 520 hooks a side wall of one of the sliding platforms 410, so that the second base 400 can be fixed with the first base 100.

With reference to FIG. 11, when mounting the tactical light 900, a force is applied to the second adjusting part 540, which causes the spring on the second adjusting part 540 to compress; at this time, the third hooking part 520 moves away from the sliding slot 180. Then, align the sliding platforms 410 with the sliding slot 180, and then push the second base 400 so that the second base 400 is completely inserted to the first base 100. The second adjusting part 540 is then loosened, and the second elastic member 150 restores to its initial state. At this time, the inner side wall of the third hooking part 520 abuts against the side wall of one of the sliding platforms 410 to fix the second base 400 to the first base 100. During detachment, a force is applied on the second adjusting part 540 to compress the spring on the second adjusting part 540. At this time, the third hooking part 520 is detached from the side wall of the sliding platform 410, and the third hooking part 520 no longer abuts against the sliding platform 410. Then, push the second base 400 in the opposite direction to disengage the second base 400 from the first base 100.

Figure 2:
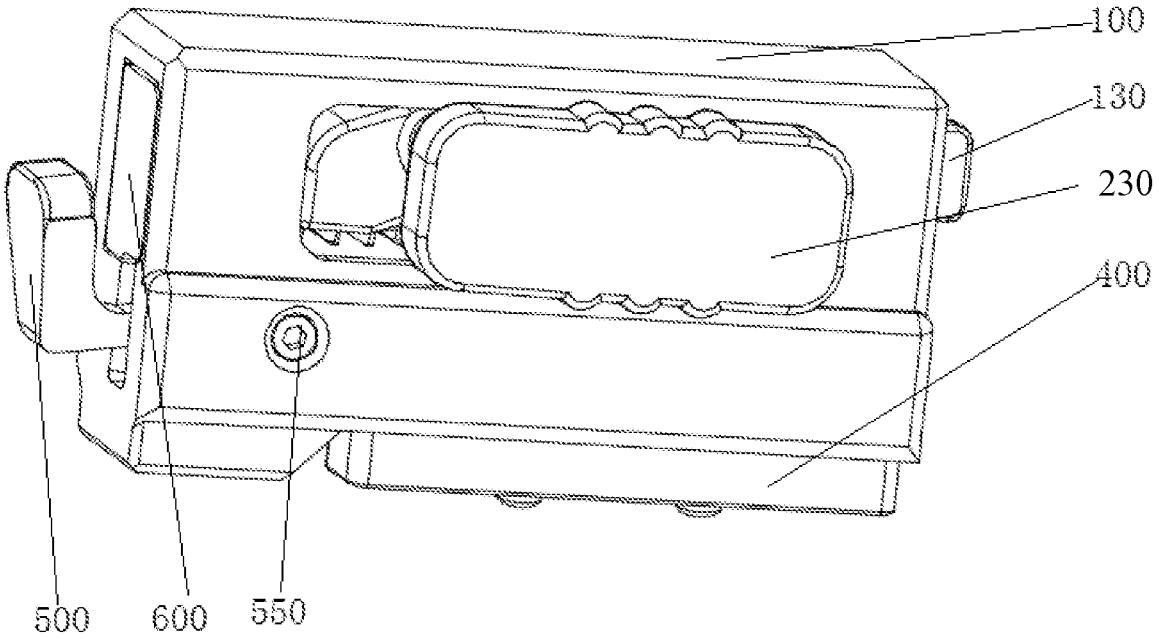
FIG. 2 is a schematic structural view of the present invention in another perspective.
Figure 3:
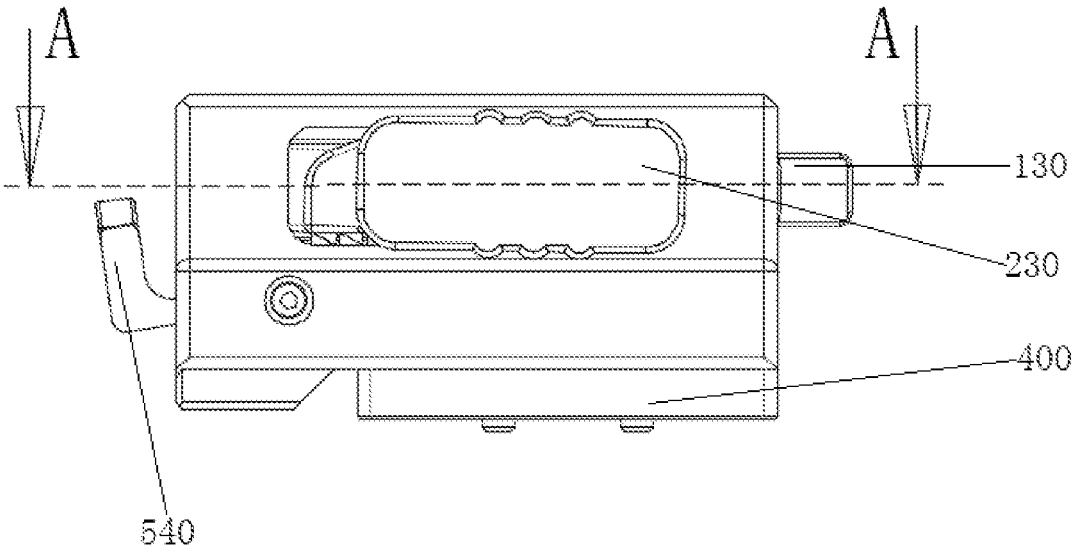
FIG. 3 is a front view of the present invention.
Figure 16:
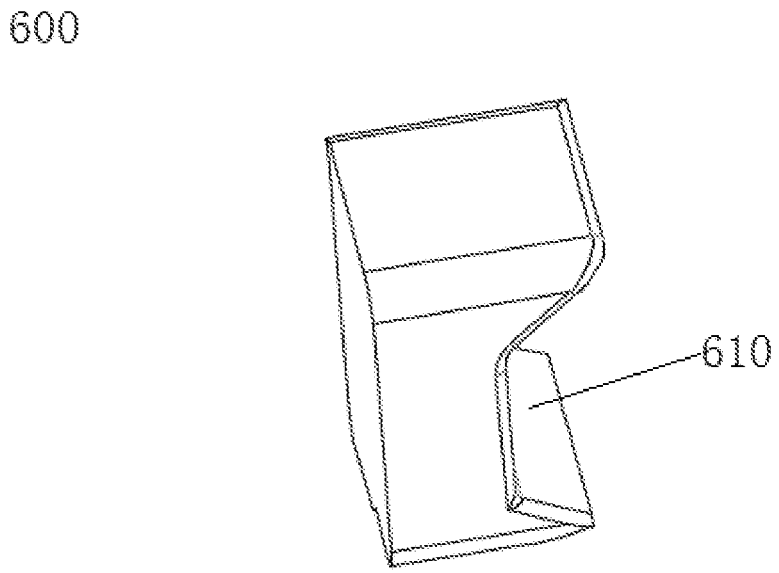
FIG. 16 is a schematic structural view of the side block of the present invention.

With reference to FIGS. 2 and 16, in this embodiment, a side block 600 is fixed in the chamber 110, and a recess 610 is provided on an end surface of the side block 600 which is close to the first connecting part 210. The recess 610 has a shape which corresponds to that of the side block 600.

Figure 14:
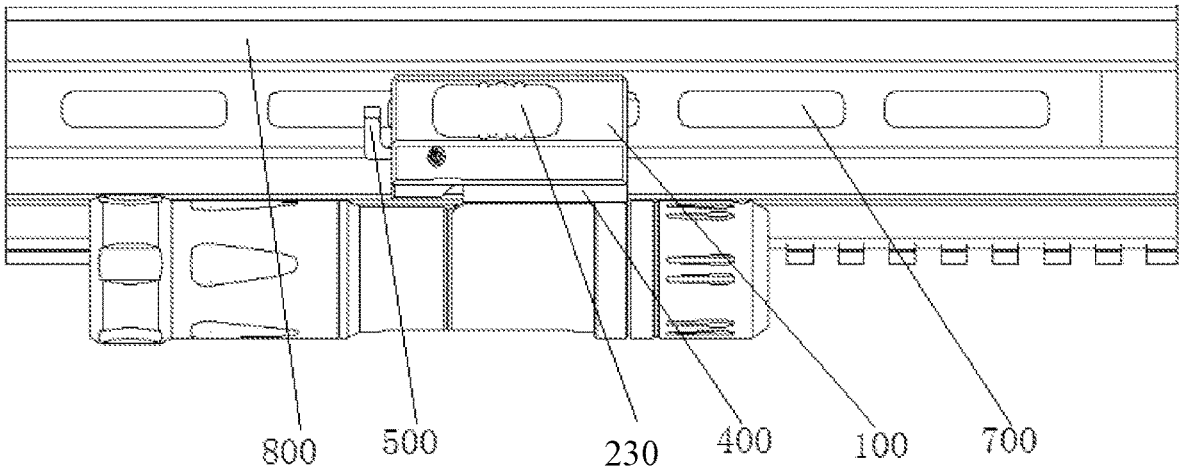
FIG. 14 is a schematic structural view showing the present invention as mounted to a firearm rail.
Figure 15:
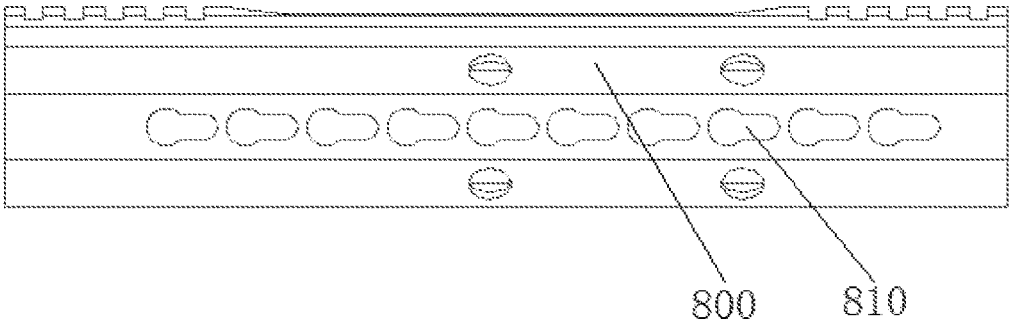
FIG. 15 is a schematic structural view showing the present invention as mounted to another type of firearm rail.

With reference to FIGS. 14 and 15, a rail 800 is provided with the first elongated slots 700 on the end surface of the rail 800 which is close to the first hooking part 130. In other embodiments, through holes 810 may be provided instead of the first elongated slots 700. In this embodiment, there are a plurality of first elongated slots 700. In other embodiments, there can be only one first elongated slot 700. The quantity and shape of the first elongated slot 700 are determined according to the distance between the first hooking part 130 and the second hooking part 220, which only needs to ensure that the second hooking part 220 can abut against the side wall of the first elongated slots 700 to fix the first base 100 and the rail 800.

The above embodiment is only one of the preferred embodiments of the present invention. General changes or replacements made by a person skilled in this field of art in accordance with the scope of teachings of the present invention should also fall within the scope of protection of the present invention.

What is claimed is:

1. A locking device for a tactical light (900) for Key-hole Modular (Key-mod) and Modular Lock (M-lok) rails (800) comprising:

a first base (100) which is movably connected to the rail (800) and provided with a chamber (110); an opening (120) is formed on each of two opposite side walls of the chamber (110); an end surface of the first base (100) which is close to the rail (800) is further provided with a first hooking part (130) for hooking the rail (800);

a movable pull rod (200) which is movably connected to the first base (100) and comprises a first connecting part (210), a second hooking part (220) connected to the first connecting part (210) for hooking the rail (800), and a first adjusting part (230) connected to the first connecting part (210); the second hooking part (220) passes through the opening (120) on one of the side walls of the chamber (110) to be disposed outside the chamber (110); the first adjusting part (230) passes through the opening (120) on the other side wall of the chamber (110) to be disposed outside the chamber (110); the first connecting part (210) is fixed to an inner wall of the chamber (110) through a first elastic member (140), so that the first hooking part (130) and the second hooking part (220) form a clamping device for fixing the first base (100) and the rail (800); the first connecting part (210) is further provided with teeth (240);

a rack (300) fixedly mounted inside the chamber (110) and provided with rack teeth (310); the rack teeth (310) and the teeth (240) cooperate to fix the movable pull rod (200) and the rack (300);

a second base (400) for fixing the tactical light (900) and having a first end surface which is fixed to the tactical light (900) and a second end surface which is fixed to the first base (100); the first end surface and the second end surface of the second base (400) face each other.

2. The locking device for a tactical light (900) for Key-mod and M-lok rails (800) as in claim 1, wherein the locking device for tactical light (900) further comprises a lever (500) rotatably connected to the first base (100); the lever (500) comprises a second connecting part (510), a third hooking part (520) extending from a first end of the second connecting part (510), a third connecting part (530) disposed between the second connecting part (510) and the third hooking part (520), and a second adjusting part (540) extending from a second end of the second connecting part (510); the third connecting part (530) is connected to the inner wall of the chamber (110) through a shaft pin (550), so that the lever (500) is rotatably connected to the first base (100); a slot (170) which extends along a stretching direction of a second elastic member (150) is formed on a side wall of the first base (100); the second connecting part (510) is fixed to the inner wall of the chamber (110) through the second elastic member (150); the third hooking part (520) is fixed with the second base (400);

the second adjusting part (540) passes through the slot (170) to be disposed outside the chamber (110); the first end and the second end of the second connecting part (510) face each other.

3. The locking device for a tactical light (900) for Key-mod and M-lok rails (800) as in claim 2, wherein the second end face of the second base (400) is provided with two sliding platforms (410); the first base (100) is correspondingly provided with a sliding slot (180); the sliding platforms (410) are inserted in the sliding slot (180); the sliding platforms (410) cooperate with the sliding slot (180) so that the second base (400) can move relative to the first base (100); the third hooking part (520) hooks a side wall of one of the sliding platforms (410) so that the second base (400) can be fixed with the first base (100).

4. The locking device for a tactical light (900) for Key-mod and M-lok rails (800) as in claim 1, wherein the openings (120) are elongated in shape, and the openings (120) each has a longitudinal direction which is parallel to a longitudinal direction of the first elastic member (140).

5. The locking device for a tactical light (900) for Key-mod and M-lok rails (800) as in claim 2, wherein the first elastic member (140) and the second elastic member (150) are springs.

6. The locking device for a tactical light (900) for Key-mod and M-lok rails (800) as in claim 5, wherein an end surface of the first connecting part (210) which is distant from the rack teeth (310) is an inclined surface.

7. The locking device for a tactical light (900) for Key-mod and M-lok rails (800) as in claim 6, wherein hook legs (221) are provided on the first hooking part (130) and the second hooking part (220), and the hook leg (221) of the first hooking part (130) and the hook leg (221) of the second hooking part (220) are arranged in opposite direction.

8. The locking device for a tactical light (900) for Key-mod and M-lok rails (800) as in claim 7, wherein a side block (600) is fixed in the chamber (110); a recess (610) is provided on an end surface of the side block (600) which is close to the first connecting part (210); the recess (610) has a shape which corresponds to that of the side block (600).

9. The locking device for a tactical light (900) for Key-mod and M-lok rails (800) as in claim 8, wherein a guide pin (160) is provided in the chamber (110); the first elastic member (140) has a first end which is fixed to the guide pin (160) and a second end which is fixed to the first connecting part (210).

10. A rail (800) for use with the locking device for a tactical light (900) for Key-mod and M-lok rails (800) as in claim 1, wherein the rail (800) is provided with a first elongated slot (700) on an end surface which is close to the first hooking part (130).

* * * * *